United States Patent [19]

Petersson

[11] Patent Number: 4,557,215

[45] Date of Patent: Dec. 10, 1985

[54] DEVICE FOR INDICATING THE CURRENT SCORE WHEN PARTICIPATING IN SPORT

[76] Inventor: Bengt Petersson, Stutaliden 33, S-434 00 Kungsbacka, Sweden

[21] Appl. No.: 539,425

[22] Filed: Oct. 6, 1983

[51] Int. Cl.[4] ..... A63B 71/06

[52] U.S. Cl. ..... 116/222; 116/307; 116/317; 116/322; 2/170; 40/21 C; 273/29 R; 273/DIG. 26

[58] Field of Search ..... 116/222, 223, 306, 307, 116/317, 322, 323, 324, 309, 321; 273/29 R, 148 R, DIG. 26; 40/21 R, 21 C, 304, 586; 2/170, DIG. 6, DIG. 11

[56] References Cited

U.S. PATENT DOCUMENTS

| | | | |
|---|---|---|---|
| 2,189,180 | 2/1940 | Rathsam | 116/236 |
| 2,716,390 | 8/1955 | Goins | 116/235 |
| 2,871,485 | 2/1959 | Greco | 40/586 |
| 3,936,963 | 2/1976 | Chan | 40/70 R |
| 4,164,910 | 8/1979 | Feiler | 116/225 |
| 4,202,544 | 5/1980 | Popma | 273/73 R |

FOREIGN PATENT DOCUMENTS

| | | | |
|---|---|---|---|
| 12749 | 12/1956 | Fed. Rep. of Germany | 40/586 |
| WO83/02563 | 8/1983 | PCT Int'l Appl. | 273/148 R |

*Primary Examiner*—Charles Frankfort
*Assistant Examiner*—W. Morris Worth

[57] ABSTRACT

A counting device to indicate a current score and intended to be worn by an individual participating in a sport. The device comprises annular indicator organs (1,2) provided with symbols (5) to indicate the score and an organ (7) with a read-off point (15). The indicator organs can be moved in relation to the read-off point so that different symbols can be advanced to that position. The main part of the device consists of soft, flexible material, preferably being some form of textile material. The device thus forms a soft, flexible, annular loop having a circumference such that it may be worn around the wrist, for example.

3 Claims, 3 Drawing Figures

DEVICE FOR INDICATING THE CURRENT SCORE WHEN PARTICIPATING IN SPORT

TECHNICAL FIELD

The present invention relates to devices for indicating the current score when participating in sport.

Participation in a wide range of sports and other physical activities requires scoring of different forms, usually the scoring of points in competitive sports such as racket sports, or the counting of laps when running or jogging and similar. A need has been identified for access to an aid to keep the scores up to date, for example in tennis where the scoring system is quite complicated.

BACKGROUND

The aforementioned need has previously been noted, and various types of instrument have been introduced for use in connection with sport. Instruments have been introduced which were mounted on an item of sporting equipment, such as a golf club. This was found to be unsuitable, however, since the instrument influences the use of the item of sports equipment in an unfavourable fashion and is also easily damaged. Furthermore, items of sports equipment are not always used. Instruments have also been introduced which were designed to be worn by the sportsman or sportswoman. In this case the instruments resembled a wrist watch or pocket watch.

Technical problem

The last-mentioned embodiment may be found to be acceptable in certain circumstances, although in other circumstances, especially when participating in energetic sports, the wearing of such an instrument may be inconvenient. Instruments of this kind have thus enjoyed very limited use in connection with sports such as tennis, squash and other activities which demand a high level of physical condition.

The Solution

In an attempt to produce a counting device which can be worn without discomfort even when participating in an energetic sport, the counting device in accordance with the present invention has been executed in a soft, flexible material, preferably being a textile material. The main part of the device is executed in this material, and there are no true instrument component parts. The material is used to produce an annular loop having a circumference such that it may be worn around part of the body, preferably around the wrist.

Advantages

The device in accordance with the invention thus has the character of an item of clothing and entirely lacks the hard body which represents at least part of prior-art devices. By avoiding additional weight and impacts from rapid movements of the body in this way, the result is a counting device which is comfortable to wear during all kinds of physical exercise.

BRIEF DESCRIPTION OF DRAWINGS

The invention is described below on the basis of two typical embodiments with reference to the accompanying drawings, in which.

BEST MODE OF CARRYING OUT THE INVENTION

Figure 1:
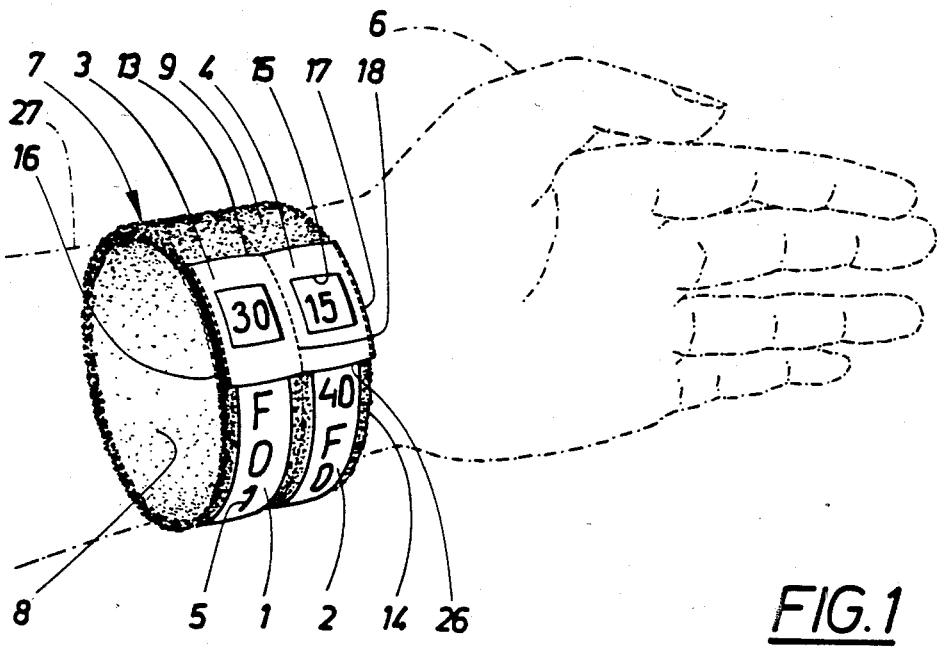
FIG. 1 shows the device in accordance with the invention in perspective view as a first embodiment.
Figure 3:
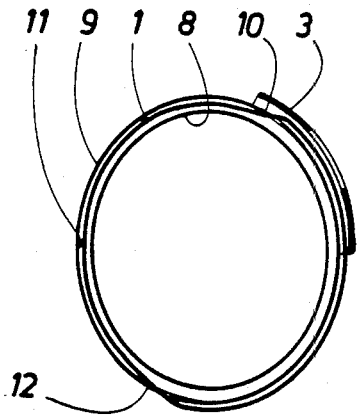
FIG. 3 shows the device in accordance with the first embodiment as a section passing centrally through a band included in the device.

As may be appreciated from the first embodiment illustrated in FIGS. 1 and 3, the device in accordance with the invention is composed of indicator bands 1, 2 which are two in number in the examples shown, together with read-off positions 3, 4 which are also two in number. The indicator bands 1, 2 exhibit in sequence a number of indications 5, intended to indicate to a sportsman or sportswoman the current score, such as the points position or similar information. The indicator device is designed to be worn by the individual participating in the sport, whose arm 27 and hand 6 are shown in FIG. 1 as lines made up of dots and dashes. The indicator device comprises a band holder 7 which is essentially annular in form and is designed to enclose the participant's arm 27 or, more precisely in the case of the example shown here, the participant's wrist. The band holder 7 may with advantage be executed in a soft, moisture-absorbent material, such as terry towelling or some other soft textile material, enabling it to serve at the same time as a sweat-band for the purpose of collecting perspiration and allowing perspiration to be wiped off on the outside of the band holder 7.

As illustrated in the diagrammatic cross-section in accordance with FIG. 3, the band holder 7 is double-layered and is executed with a backing layer 8 designed to make close contact with the wrist and to form a basis for the two indicator bands 1, 2 together with a covering layer 9 designed to cover the indicator bands 1, 2 over a large part of their circumference. As may be seen from the Figures, the bands are executed in the form of two endless loops and are made from an easily flexible material, for example an elasticated textile material such as elasticated tape. The indicator bands 1, 2 also extend at the associated read-off points 3, 4 into and below the covering layer 1 through a first opening 10 and then continue between the two layers in a channel 11, after which they emerge from the channel through a second opening 12 and are exposed as far as the read-out points 3, 4. The indicator bands points 1, 2 thus run in their own channel 11 which is separated from the other channel, said separation being provided by means of a central, annular seam 13 passing through the two layers 8, 9 making up the band holder 7. The channels 11 are naturally closed along their outer edges, i.e. along the outer edges of the band holder 7, either by making the band holder 7 from material in the form of a loop or by making it from material which is folded double and sewn along one of its long edges 14.

The read-off points 3, 4 are executed in the form of a piece of flexible material bridging the two indicator bands 1, 2, for example a textile material, leather or imitation leather. The bridging piece read-off points 3, 4 may with advantage be executed in a rather more dimensionally stable manner than the rest of the device and may be provided each with its own read-off window 15, which may with advantage be kept relatively dimensionally stable so as to facilitate reading the figures. The bridging piece is attached to the hand holder 7 partly along its outer edges 16, 17 and partly along a seam 18 which defines the limit of the two read-off points. This seam 18 may with advantage be common with the seam 13.

Figure 2:
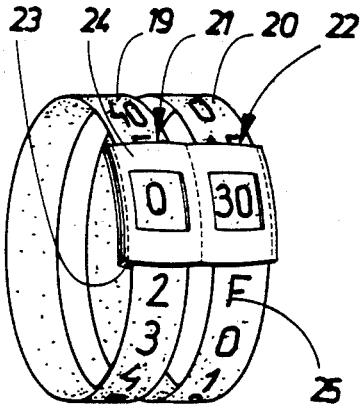
FIG. 2 shows the device in accordance with the invention as a second embodiment.

In the embodiment in accordance with FIG. 2, the indicator bands 19, 20 are the same as in the first embodiment, although the band holder is absent. In this case the read-off points 21, 22 are executed with a backing component 23 permitting the band to pass through the read-off points 21, 22 between the bridging piece 24 and the backing component 23. Thus, in the second embodiment, the indicator bands 19, 20 are designed to be in direct contact with the wrist and as such must serve as the retaining organs and should preferably be elasticated so as to hold the device firm, and at the same time permitting one or two fingers of the hand to be inserted beneath the indicator band in the event of it requiring to be moved. The indicator band should exhibit relatively low friction to the wrist and to the inner surfaces of the read-off points 21, 22 at the same time as the backing component 23 for the read-off points should exhibit greater friction on its surface facing the wrist so as to prevent the read-off points from being displaced when the device is in use.

Both of the embodiments described above are intended for use in connection with tennis in particular, this being determined by the selected indications 5, 25 appearing on the indicator bands 1, 2, 19, 20. Thus, the following lists of indications could be selected for the indicator bands:

| Band I | Band II |
|---|---|
| 0 | 0 |
| 15 | 15 |
| 30 | 30 |
| 40 | 40 |
| F | F |
| 0 | 0 |
| 1 | 1 |
| 2 | 2 |
| 3 | 3 |
| 4 | 4 |
| 5 | 5 |
| 6 | 6 |
| 7 | 7 |
| 8 | 8 |
| 9 | 9 |

One of the indicator bands 1, 19 is thus intended to show the position for one of the players, whereas the indicator band 2, 20 is intended to show the position for the other player, with the information being read at each read-off point 3, 4, 21, 22 through the window 15. Thus, the indication shown can be changed by imparting movement to displace each of the indicator bands in turn. By imparting different relative movement to the two indicator bands, different indications may be displayed for the respective players, depending on the number of points scored. The first group of indications 5, 25 from 0–F shows the points position for the respective players in each game, whilst the following series of numbers from 1–9 relates to the points position in a so-called tie-break situation. This consecutive series of numbers may also be used to indicate the position reached in a game or set. However, this would require more than one indicator device per player, or else a design having a larger number of bands would have to be chosen if it were wished to keep abreast of more than just one or other of the alternative positions.

As mentioned above, the indicator bands 1, 2 in the first embodiment are exposed over only a certain distance on the circumference of the band. This distance is thus the distance between the opening 12 in the channel 11 and one of the transverse edges 26 of the read-off points 3, 4. It is preferable if this distance can be selected so as to assist in providing a simple indication of the necessary displacement of the band when changing from one position to another in a single step. The band in question is gripped close to the opening 12 by the thumb of one hand and by one or two fingers, and the band is then moved until the fingers make contact with the transverse edge 26 of the read-off points 3, 4. This movement is greater than the division of the indications 5 due to the fact that account has been taken of elasticity in the indicator band 1, 2. In this way the numbers displayed can be changed without the need to look closely at the indication so as to ensure that it appears at the centre of the display window 17, and the movement can be executed rapidly and simply after each ball has been played, possibly casting a rapid glance at the window 17. In the embodiment in accordance with FIGS. 1 and 3, the gripping action is made easier by executing the band holder 7 preferably in a relatively thick, deformable material which will yield when a finger is to be inserted beneath the band in question. In the embodiment in accordance with the FIG. 2, a finger may be inserted easily beneath the band thanks to the give of the skin.

The indicator device in accordance with the invention is particularly suitable for those applications in which the participant in the sport is wearing relatively tight-fitting clothing and requires complete freedom to move quickly without being weighed down by cumbersome accessories. The indicator device is thus executed in accordance with the invention in a light and comfortable material, preferably of the same nature as the other clothing being worn by the participant, for example some form of textile material, making the device particularly robust and sensitive.

The invention is not restricted to the embodiments described above and illustrated in the drawings, but may be modified within the context of the following Patent Claims. For example, the indicator device may easily be modified for use in other sports, in particular those sports having two players or teams, such as badminton or squash. In this case the indications are changed for indications of a kind which are specially suited to the sport in question. It is also conceivable for the device to be used by runners, joggers or similar athletes for the purpose of counting laps. The device could also be used in other sports, such as golf, to keep the points position up to date.

I claim:

1. A device to be worn by an individual participating in sport, athletics or other physical activity for indicating a current score or similar information, comprising a main part of a soft, flexible, moisture-absorbent material serving as a sweat-band in the form of an annular loop having a circumference, and to be worn around a part of the body of the individual, said sweat-band including a backing layer, a covering layer, and at least one read-off window affixed to said covering layer, a number of annular indicator bands disposed between the backing layer and the covering layer over a portion of their length, said number of indicator bands corresponding to the number of read-off windows and provided with a number of symbols for indicating the score, said indicator bands being movable in relation to the read-off windows so that different symbols can be advanced to a position so as to be viewable through the respective read-off window, said covering layer being open at two locations for exposing the indicator bands over a distance allowing gripping of the bands for moving said indicator bands relative to the read-off windows.

2. A device as claimed in claim 1, wherein the number of indicator bands and read-off windows is two, the read-off windows being provided in a piece common to both indicator bands, said piece being stitched to said main part along two edges thereof and centrally between the indicator bands, the indicator bands being located side by side in the main part, the indicator bands being of elasticated material, and a central seam defining channels for the indicator bands in the main part and which runs between the two layers of the main part.

3. A device as claimed in claim 2, wherein one of the indicator bands displays points, game, or set positions of one of two players, and the other indicator band displays a corresponding position of the other player, the symbols displayed on each indicator band showing in sequence initially each points position 0, 15, 30 . . . , followed by a continuous numerical sequence, such as 1, 2, 3, 4, 5 . . . , representing either tie breaker points or game or set positions for the respective player.

* * * * *